US007699184B2

(12) United States Patent
Meissen

(10) Patent No.: US 7,699,184 B2
(45) Date of Patent: Apr. 20, 2010

(54) BOTTLE CARRIER

(75) Inventor: Cynthia R. Meissen, Atlanta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 11/415,404

(22) Filed: May 1, 2006

(65) Prior Publication Data

US 2006/0243627 A1 Nov. 2, 2006

Related U.S. Application Data

(60) Provisional application No. 60/677,197, filed on May 2, 2005.

(51) Int. Cl.
*B65D 21/028* (2006.01)
*B65D 90/02* (2006.01)
*B65D 25/04* (2006.01)

(52) U.S. Cl. ..... 220/23.4; 220/23.83; 220/675; 220/553

(58) Field of Classification Search ..... 206/512, 206/504, 144, 193, 140; 220/23.6, 509, 515, 220/519, 676, 670, 23.8, 516, 517, 510, DIG. 2, 220/DIG. 15, 555, 553; 215/200; D9/759, D9/756, 737; 446/111, 112, 113, 116
See application file for complete search history.

(56) References Cited

U.S. PATENT DOCUMENTS 820,445 A * 5/1906 Speer ..... 220/509
975,962 A * 11/1910 Kruse ..... 217/21
1,370,525 A * 3/1921 Eisenkraft ..... 206/562
1,817,805 A * 8/1931 Davenport ..... 220/509
2,061,262 A * 11/1936 Weisz ..... 222/584
2,102,982 A * 12/1937 Taylor ..... 211/1.53
2,169,399 A * 8/1939 Steiner ..... 242/596.7
2,208,431 A * 7/1940 Rochow ..... 366/130
2,257,536 A * 9/1941 Roycroft ..... 211/126.1

(Continued)

FOREIGN PATENT DOCUMENTS

DE 200 06 695 U1 7/2000

(Continued)

OTHER PUBLICATIONS

Fonderie de Precision. Translation of FR-1590201 "Bottle Rack". May 22, 1970. p. 4 Lines 3-4.*

(Continued)

*Primary Examiner*—Anthony Stashick
*Assistant Examiner*—Robert J Hicks
(74) *Attorney, Agent, or Firm*—Carlson, Gaskey & Olds

(57) ABSTRACT

A bottle carrier includes a plurality of walls. At least one of the walls includes a recess on an exterior surface for retaining a bottle thereon, when the carrier is in a horizontal orientation and the bottle is in a horizontal orientation partially disposed in the recess. The carrier may be stackable and connectable to similar carriers to form display or storage racks. At least one of the walls includes a plurality of feet extending therefrom. The feet are interlockable with feet on a similar carrier. When similar carriers are stacked, the feet interlock to improve the stability of the stacked carriers. Adjacent carriers may be connected via corks or other connectors inserted into adjacent walls of the carriers.

34 Claims, 14 Drawing Sheets

U.S. PATENT DOCUMENTS

| | | | | | |
|---|---|---|---|---|---|
| 2,325,863 | A | | 8/1943 | Johnson | |
| 2,358,795 | A | * | 9/1944 | Djidics et al. | 102/317 |
| 2,452,195 | A | | 10/1948 | Johnson | |
| 2,903,150 | A | | 9/1959 | Rehrig | |
| 3,006,522 | A | * | 10/1961 | Arneson | 229/5.5 |
| 3,224,632 | A | * | 12/1965 | Marcalus | 221/48 |
| 3,325,039 | A | | 6/1967 | Schiphorst | |
| 3,341,053 | A | * | 9/1967 | Keene | 220/517 |
| 3,392,869 | A | | 7/1968 | Needt | |
| 3,404,805 | A | * | 10/1968 | Stockman et al. | 206/144 |
| 3,478,867 | A | * | 11/1969 | Weiss | 206/564 |
| 3,802,595 | A | | 4/1974 | Frahm et al. | |
| 3,809,834 | A | | 5/1974 | Hipple | |
| D233,817 | S | | 12/1974 | Matthews | |
| 3,889,834 | A | | 6/1975 | Harris, Jr. | |
| 4,099,626 | A | | 7/1978 | Magnussen, Jr. | |
| 4,143,784 | A | | 3/1979 | Frahm et al. | |
| 4,287,997 | A | * | 9/1981 | Rolfe et al. | 220/1.5 |
| 4,506,796 | A | | 3/1985 | Thompson | |
| 4,520,941 | A | | 6/1985 | Hagan et al. | |
| 4,589,560 | A | | 5/1986 | Harris, Jr. | |
| 4,662,669 | A | * | 5/1987 | Erickson et al. | 294/68.27 |
| 4,733,626 | A | * | 3/1988 | Svirklys et al. | 114/267 |
| 4,799,592 | A | | 1/1989 | Hessmert | |
| 4,868,028 | A | | 9/1989 | de Rothschild | |
| 4,901,876 | A | | 2/1990 | Box | |
| 4,942,967 | A | | 7/1990 | Schneider | |
| 4,942,975 | A | * | 7/1990 | Capron et al. | 220/23.4 |
| 4,971,275 | A | | 11/1990 | Roberts | |
| 5,071,026 | A | | 12/1991 | Apps | |
| 5,097,980 | A | | 3/1992 | Warwick | |
| 5,191,994 | A | | 3/1993 | Stauble | |
| 5,261,208 | A | | 11/1993 | Lockhart | |
| 5,339,979 | A | | 8/1994 | Box | |
| 5,370,245 | A | | 12/1994 | Tersch et al. | |
| 5,405,042 | A | | 4/1995 | Apps et al. | |
| 5,593,037 | A | | 1/1997 | Ohayon | |
| 5,947,305 | A | | 9/1999 | Lin | |
| 6,026,958 | A | | 2/2000 | Kelly et al. | |
| 6,142,300 | A | | 11/2000 | Kelly et al. | |
| 6,971,327 | B2 | * | 12/2005 | Mattson | 114/266 |
| 2004/0159659 | A1 | * | 8/2004 | Rumpel | 220/7 |
| 2005/0098558 | A1 | * | 5/2005 | Rae | 220/23.4 |
| 2005/0176532 | A1 | * | 8/2005 | Thorington | 473/595 |
| 2005/0274639 | A1 | * | 12/2005 | Meissen | 206/427 |
| 2006/0049075 | A1 | * | 3/2006 | Chen | 206/504 |

FOREIGN PATENT DOCUMENTS

| | | | | |
|---|---|---|---|---|
| DE | 199 36 683 | A1 | | 2/2001 |
| DE | 203 20 695 | U1 | | 12/2004 |
| FR | 1 590 201 | | | 4/1970 |
| FR | 2726538 | A1 | * | 5/1996 |
| GB | 1 345 247 | | | 1/1974 |
| WO | WO 8501267 | A1 | * | 3/1985 |

OTHER PUBLICATIONS

International Search Report, Dec. 6, 2006.

* cited by examiner

BOTTLE CARRIER

This application claims priority to U.S. Provisional Application Ser. No. 60/677,197, filed May 2, 2005.

BACKGROUND OF THE INVENTION

The present invention relates generally to a case for carrying bottles and more particularly to a reusable carrier that can be connected to similar carriers to form display racks or storage racks.

Wine bottles are typically shipped in cardboard boxes to stores. At the store the bottles are removed from the boxes and arranged on shelves for display to customers. The wine bottles are also often displayed for sale in the store in the boxes. However, this arrangement makes it difficult for customers to see the products.

Consumers who purchase a case of wine carry the bottles home in the cardboard boxes. If the wine has been removed for display purposes the cardboard boxes must be repacked. These boxes are typically not sturdy and may be subject to damage from water, the environment, etc. These boxes are typically not reused or returned to the store.

It is therefore desirable to develop and design an improved bottle carrier for storing and displaying bottles.

SUMMARY OF THE INVENTION

A bottle carrier includes at least one base wall and a plurality of walls connected to the base and extending upward. At least one of the walls includes a recess on an exterior surface for holding a bottle. When the carrier is in a horizontal orientation, a bottle in a horizontal orientation can be partially disposed in the recess. The recess may include a plurality of concave portions formed in ribs projected from the wall.

The carrier may be stackable and connectable to similar carriers to form display or storage racks. At least one of the walls includes a plurality of feet extending therefrom. The feet are interlockable with feet on a similar carrier. When similar carriers are stacked, the feet interlock to improve the stability of the stacked carriers.

Adjacent carriers may be connected by corks or other cylindrical connectors inserted into apertures through walls in each of the carriers.

These and other features of the present invention can be best understood from the following specification and drawings, the following of which is a brief description.

DETAILED DESCRIPTION OF THE PREFERRED EMBODIMENT

Figure 1:
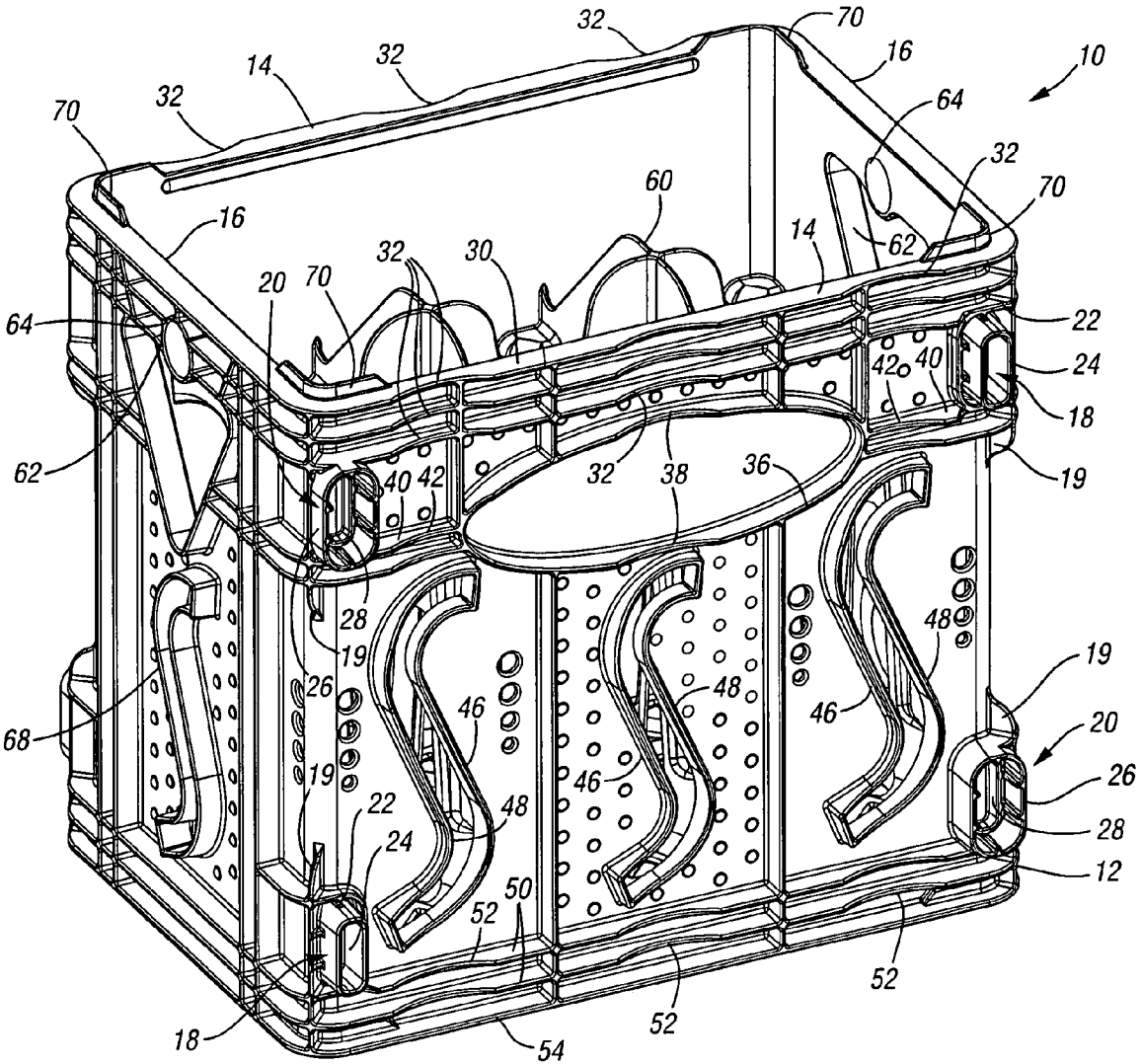
FIG. 1 is a perspective view of an example bottle carrier according to one embodiment of the present invention.

A bottle carrier 10 according to one example embodiment of the present invention is shown in FIG. 1. The carrier 10 includes a pair of opposed side walls 14 and a pair of opposed end walls 16 extending upwardly. The carrier 10 is preferably integrally molded of polypropylene, HDPE, polycarbonate or other suitable material via injection molding or other suitable process.

Each of the side walls 14 includes a pair of first feet 18 arranged at diagonally opposite corners and a pair of second feet 20 arranged at the other diagonally opposite corners. Each of the first feet 18 includes a U-shaped outer rib 22 and a generally oval inner wall 24, nested within the outer rib 22. The outer rib 22 is substantially shorter than the inner wall 24. Each of the second feet 20 includes a generally oval outer wall 26 and a generally cylindrical oblong inner wall 28 nested therein. The inner wall 28 is substantially shorter than the outer wall 26. The inner walls 24 of the first feet 18 are sized to interlock within the outer walls 26 of the second feet 20 when similar bottle carriers 10 are stacked, as will be explained further below.

Each side wall 14 includes an upper band comprising a plurality (three in this example) of horizontal upper ribs 30 protruding outwardly from the side wall 14. The outer edges of the upper ribs 30 include a plurality (three in this example) of concave sections 32. Each side wall 14 further includes a label area defined by an elliptical rib 36. The elliptical rib 36 includes a plurality of concave portions 38.

Each side wall 14 further includes horizontal middle ribs 40, each having a plurality of concave portions 42. Corner fins 19 extend vertically in each corner just outward of each of the first feet 18 and the second feet 20. The corner fins 19 connect the upper ribs 30 and middle ribs 40.

Each side wall 14 further includes a plurality of logo ribs 46 that each define a logo (in this case, an "S" shape) and extend about the periphery of an opening through the side wall 14. Each of the logo ribs 46 includes a plurality of concave portions 48. Each side wall 14 further includes a plurality of horizontal lower ribs 50, each having a plurality of concave portions 52. The concave portions 32, 42, 48, 52 of the ribs 30, 40, 46, 50 are aligned along a vertical axis (in FIG. 1) with one another to form bottle-receiving recesses on the outer surface of the side wall 14. A horizontal bottom rib 54 protrudes outwardly from the side wall 14 and does not include concave portions.

A plurality of dividers 60 define a plurality of bottle-receiving pockets within the interior of the carrier 10. Each end wall 16 includes a handle 62, which as shown can be a large opening through the end wall 16. Further, each end wall 16 includes a connection aperture 64 extending through the end wall 16 above the handle 62. Each end wall 16 further includes a logo rib 68 both defining a logo (in this example, an "S" shape) and extending about the periphery of an opening into the interior of the carrier 10.

A plurality of corner ridges 70 extend upwardly from the upper edges of the corners where the side walls 14 and end walls 16 meet. The corner ridges 70 extend upwardly from the inner edge of the upper edge of each corner.

Figure 1A:
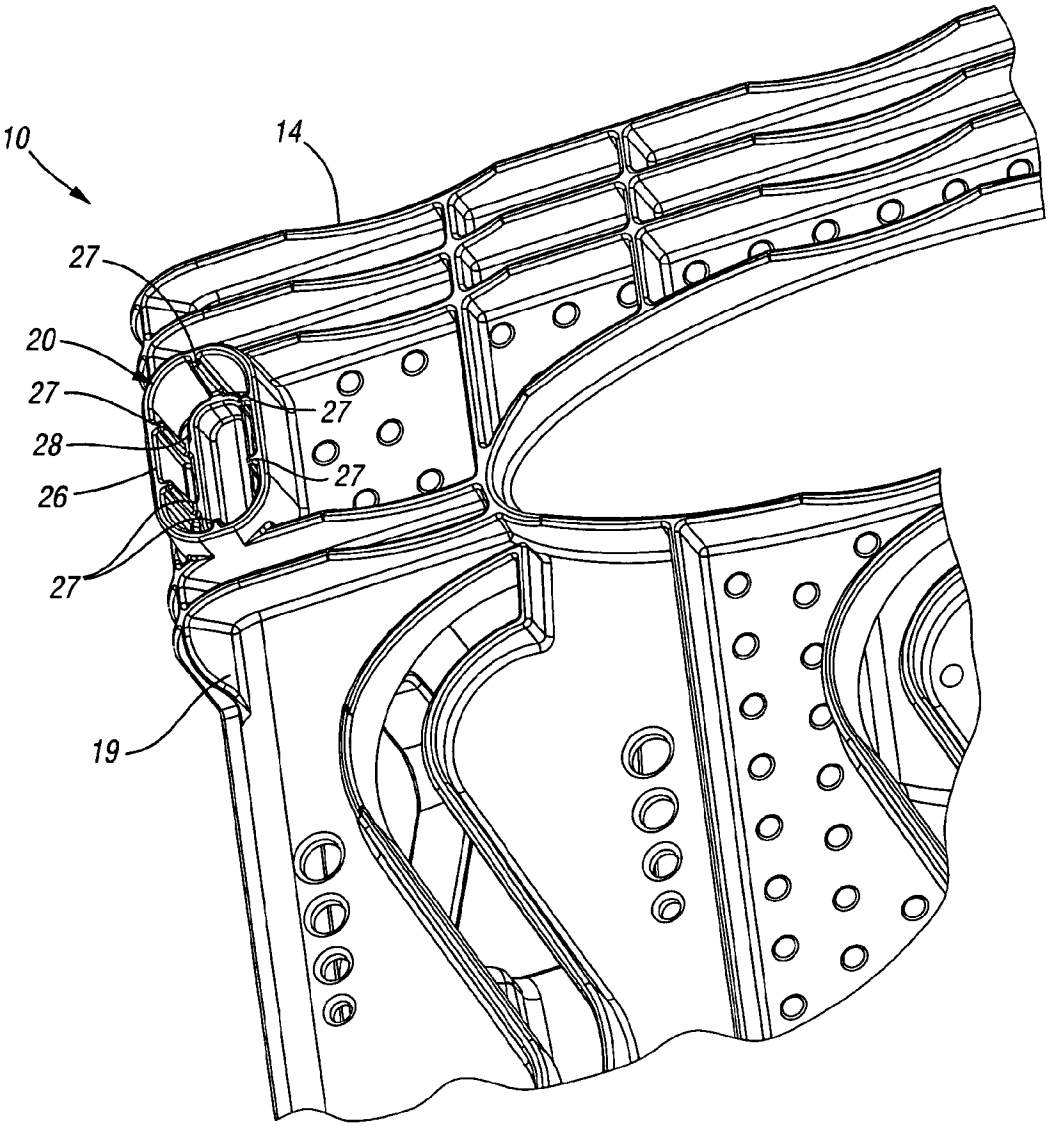
FIG. 1*a* is an enlarged perspective view of one of the second feet.

FIG. 1*a* is a partial perspective view of the carrier 10, enlarged to show one of the second feet 20 in more detail. The second feet 20 each include a plurality of vertical ribs 27 extending along an interior surface of the outer wall 26. The ribs 27 extend from the outer wall 26 to the inner wall 28. The ribs 27 also extend to an outer edge of the outer wall 26.

Figure 2:
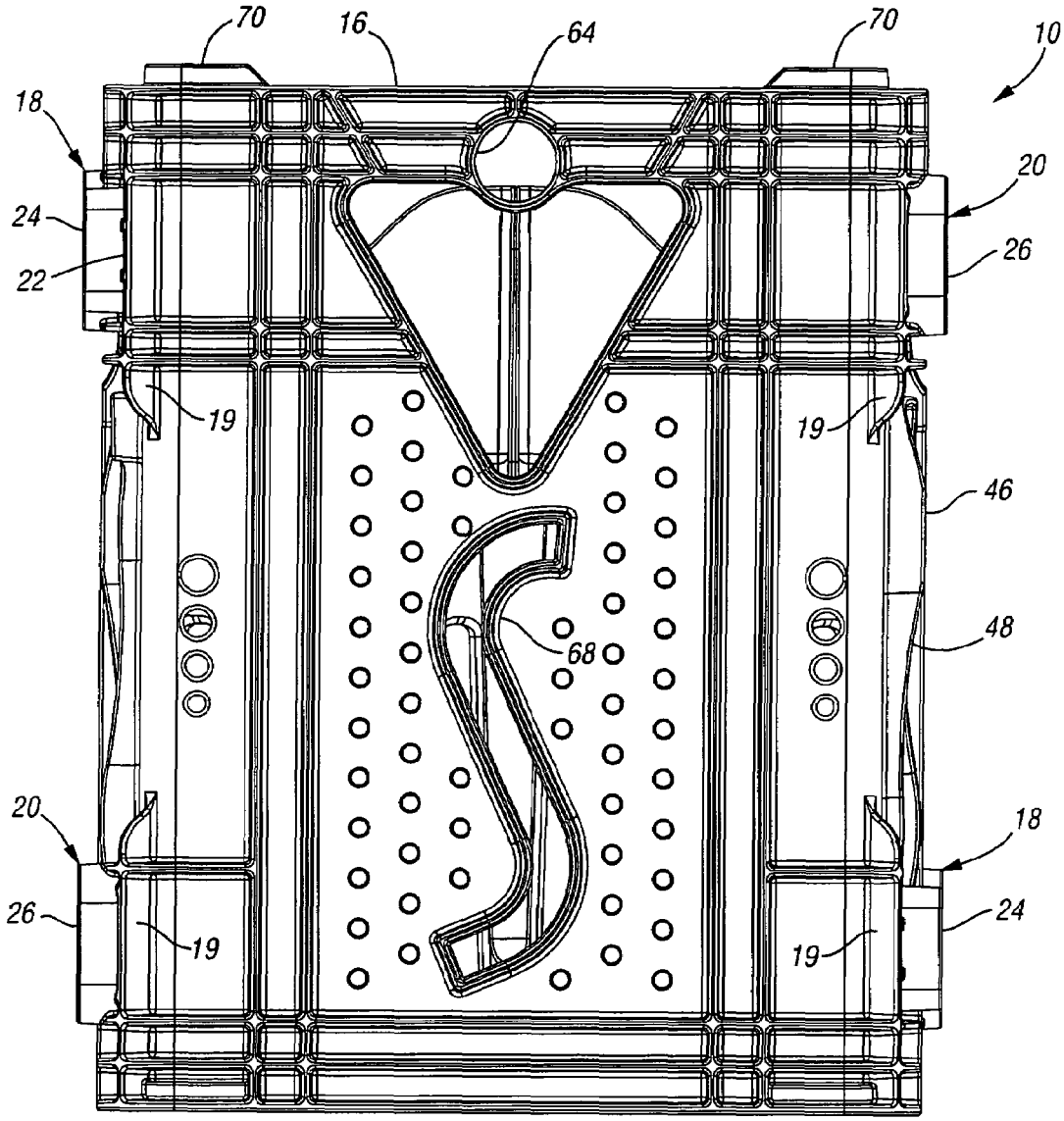
FIG. 2 is an end view of the carrier.

FIG. 2 is an end view of the carrier 10. The connection aperture 64, handle 62 and opening defined by logo rib 68 all extend through the end wall 16. As can be seen in FIG. 2, the outer walls 26 of the second feet 20 protrude outwardly of a plane that defines the outer plane of the side wall 14. Similarly, the inner walls 24 of the first feet 18 also protrude outwardly of the plane that defines the outer plane of the side wall 14.

Figure 2A:
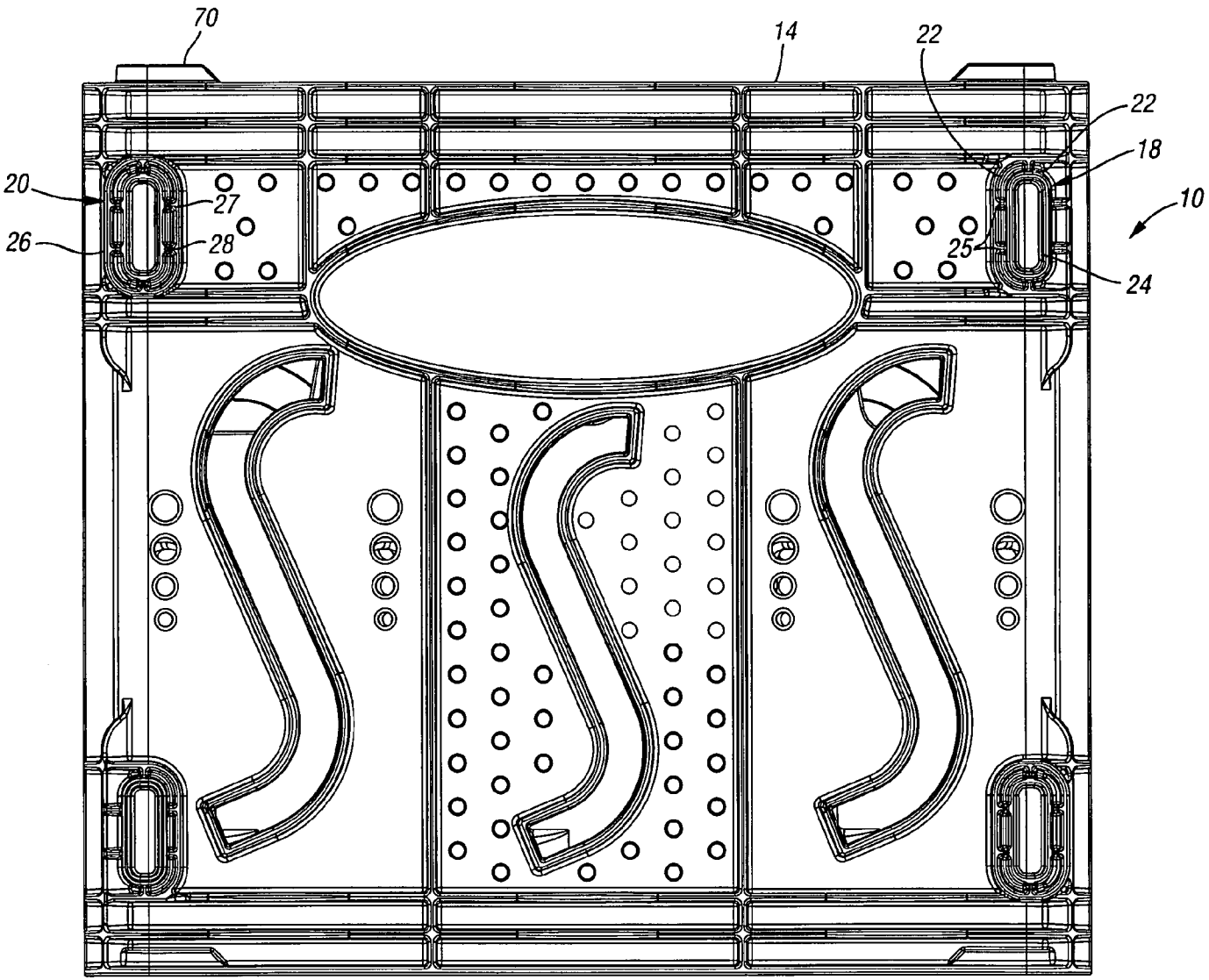
FIG. 2*a* is a side view of the carrier.

FIG. 2*a* is a side view of the carrier 10. The outer rib 22 of the first feet 18 include a pair of ribs 25 connected to the inner wall 24.

Figure 3:
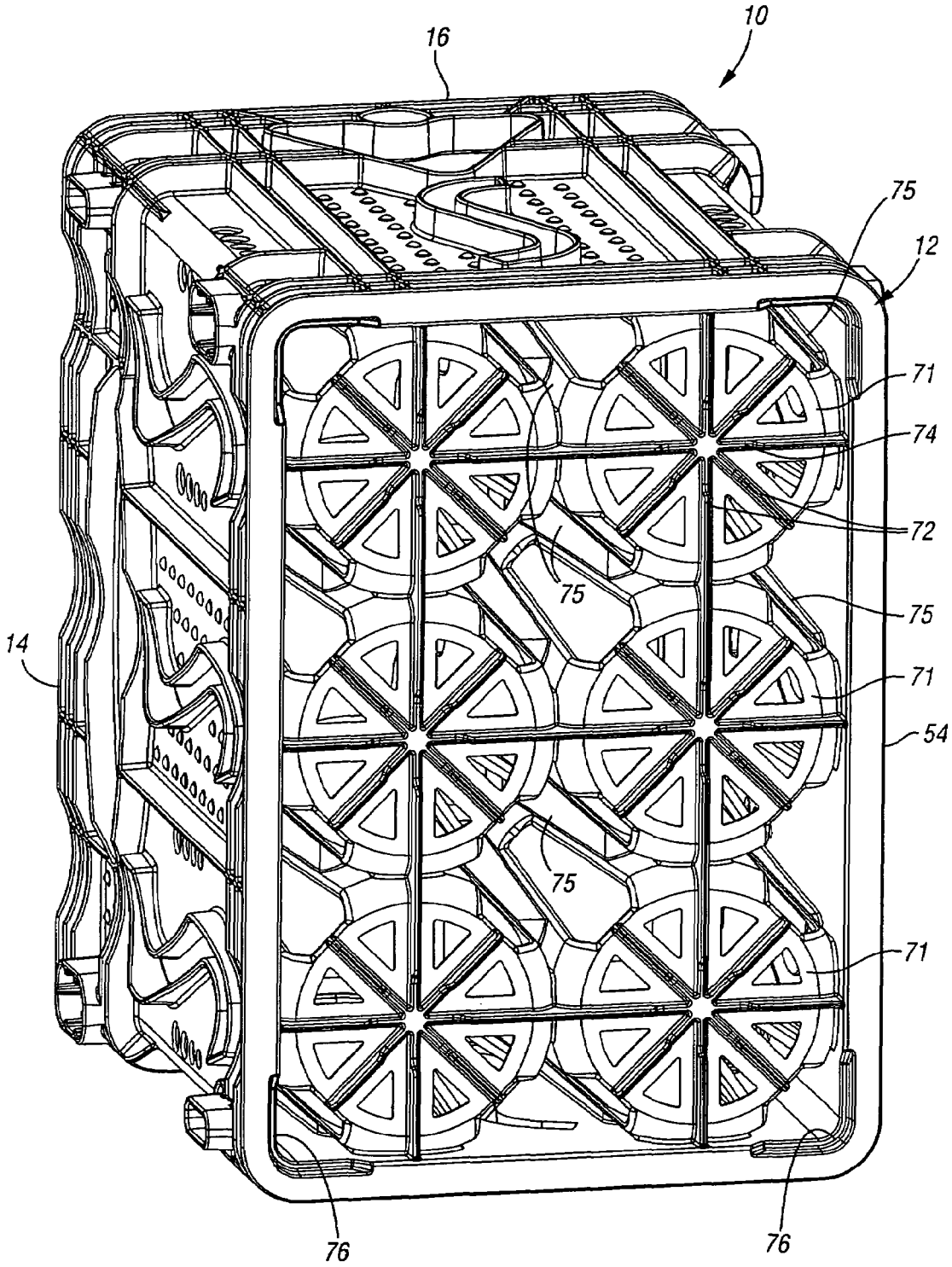
FIG. 3 is a bottom perspective view of the carrier.
Figure 3A:
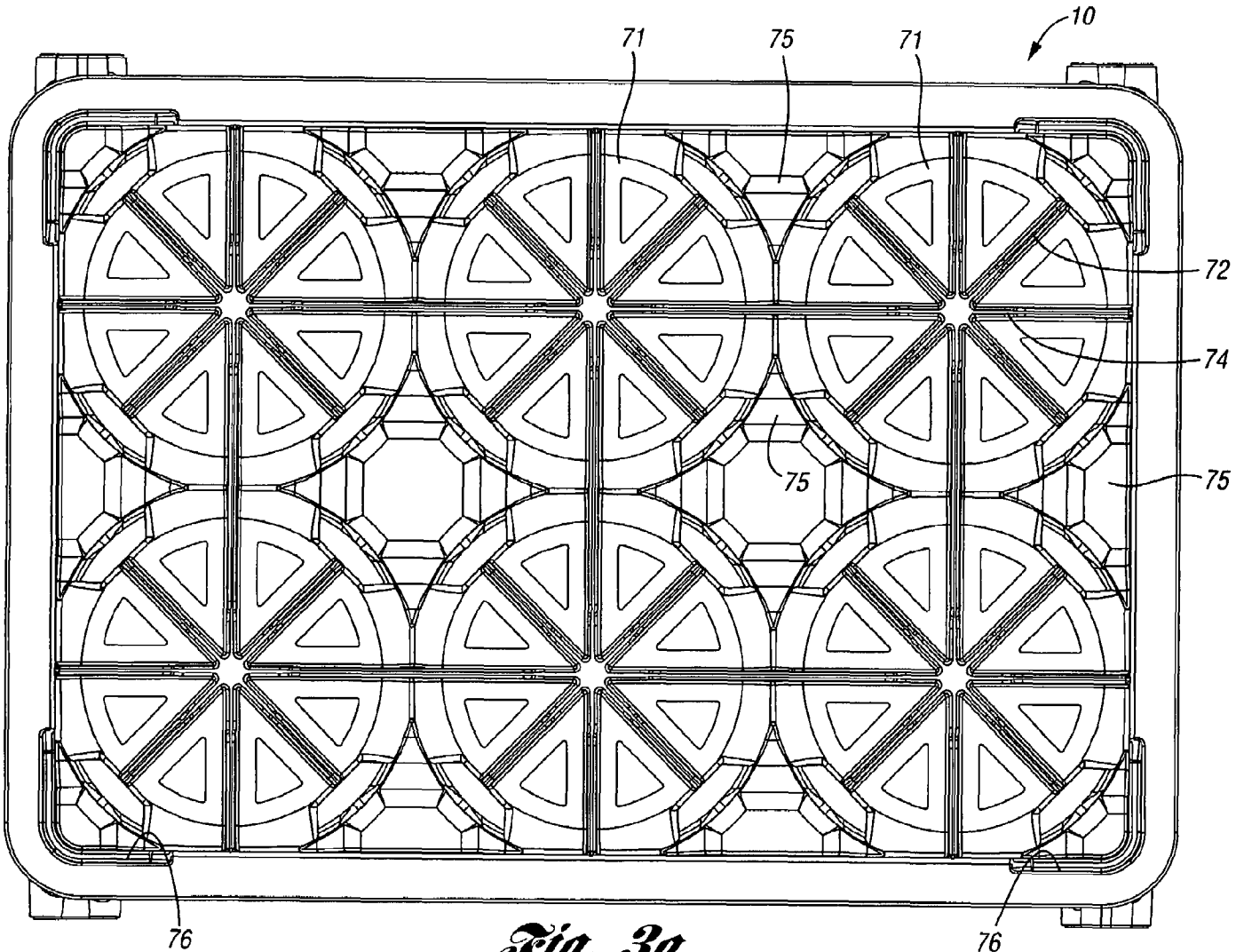
FIG. 3*a* is a bottom view of the carrier.

FIG. 3 is a bottom perspective view of the carrier 10 and FIG. 3*a* is a bottom view of the carrier 10. A base wall 71, which in the illustrated example is generally circular, defines a bottom of each bottle receiving pocket. A plurality of radial ribs 72 on each base wall 71 define a bottle top receiving recess 74 aligned with the bottle-receiving pocket (FIG. 1) in the interior of the carrier 10. Tapered columns 75 with large side openings extend vertically upward between each of the base walls 71 and partial columns 75 extend between each of the base walls 71 and the side walls 14 and end walls 16.

Recesses 76 formed on the interior surface of the bottom rib 54 are complementary to and aligned with the corner ridges 70 (FIG. 1) on the upper edge of the carrier 10, such that the corner ridges 70 of one carrier 10 are received in the recesses 76 of a carrier stacked thereon to improved the stability of the stack (if the lower carrier 10 is empty or if the bottles in the carrier do not extend out above the upper edges of the lower carrier 10).

Figure 4:
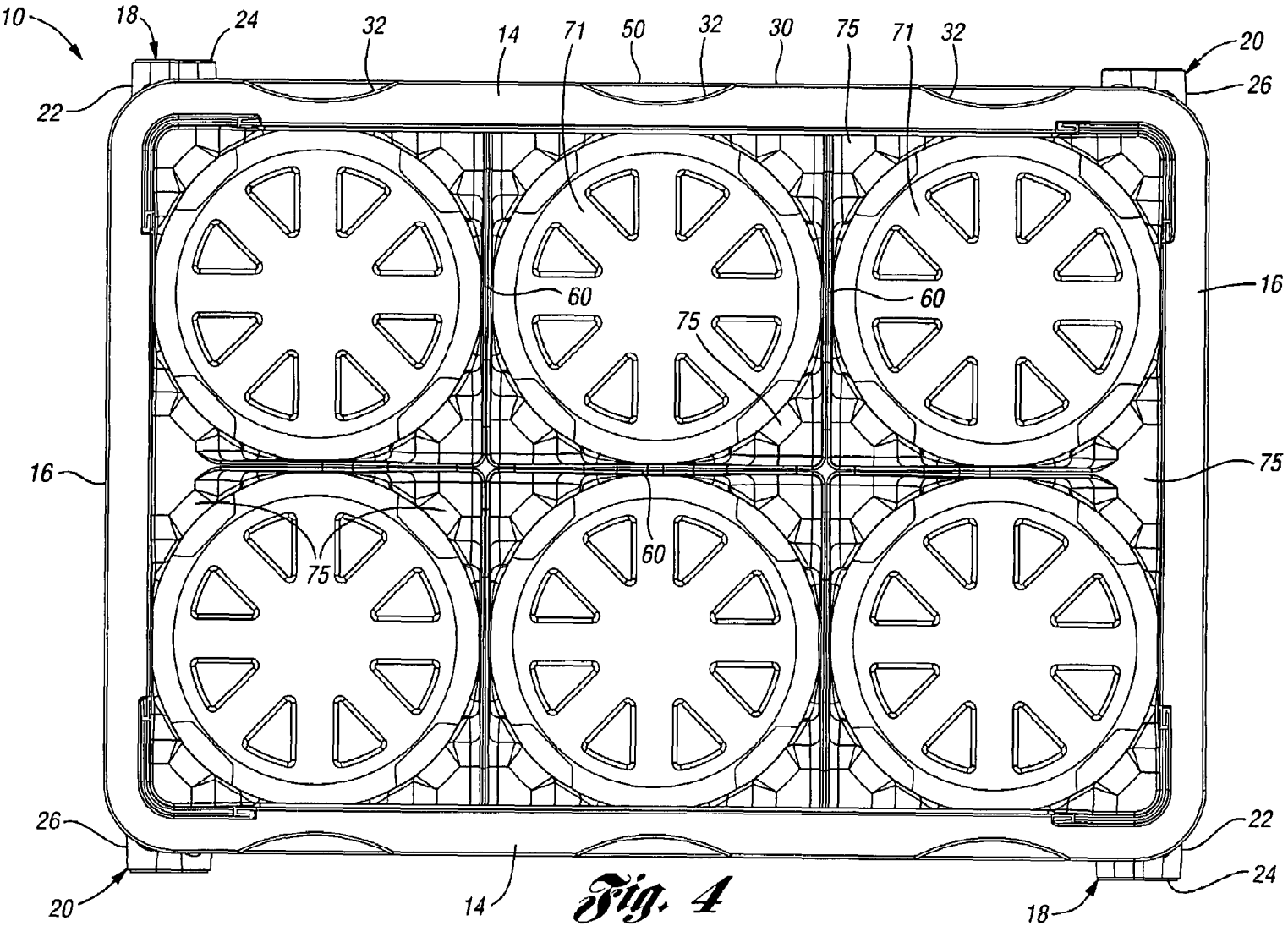
FIG. 4 is a top view of the carrier.

FIG. 4 is a top view of the carrier 10. As shown, the columns 75 extend upwardly between adjacent, perpendicular dividers 60 to further support a bottle in each bottle-receiving pocket.

Figure 5:
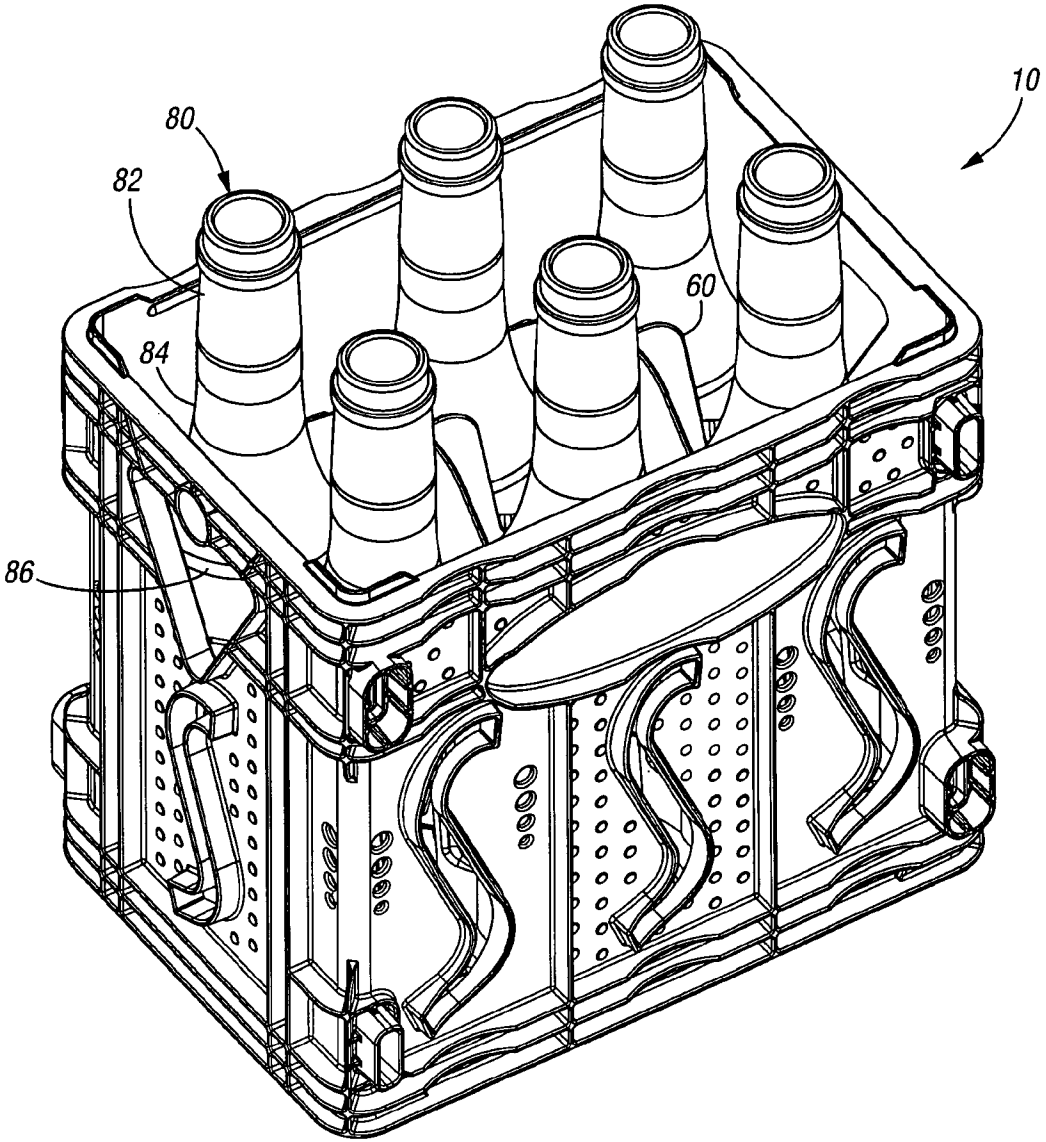
FIG. 5 is a perspective view of the carrier loaded with a plurality of bottles.
Figure 6:
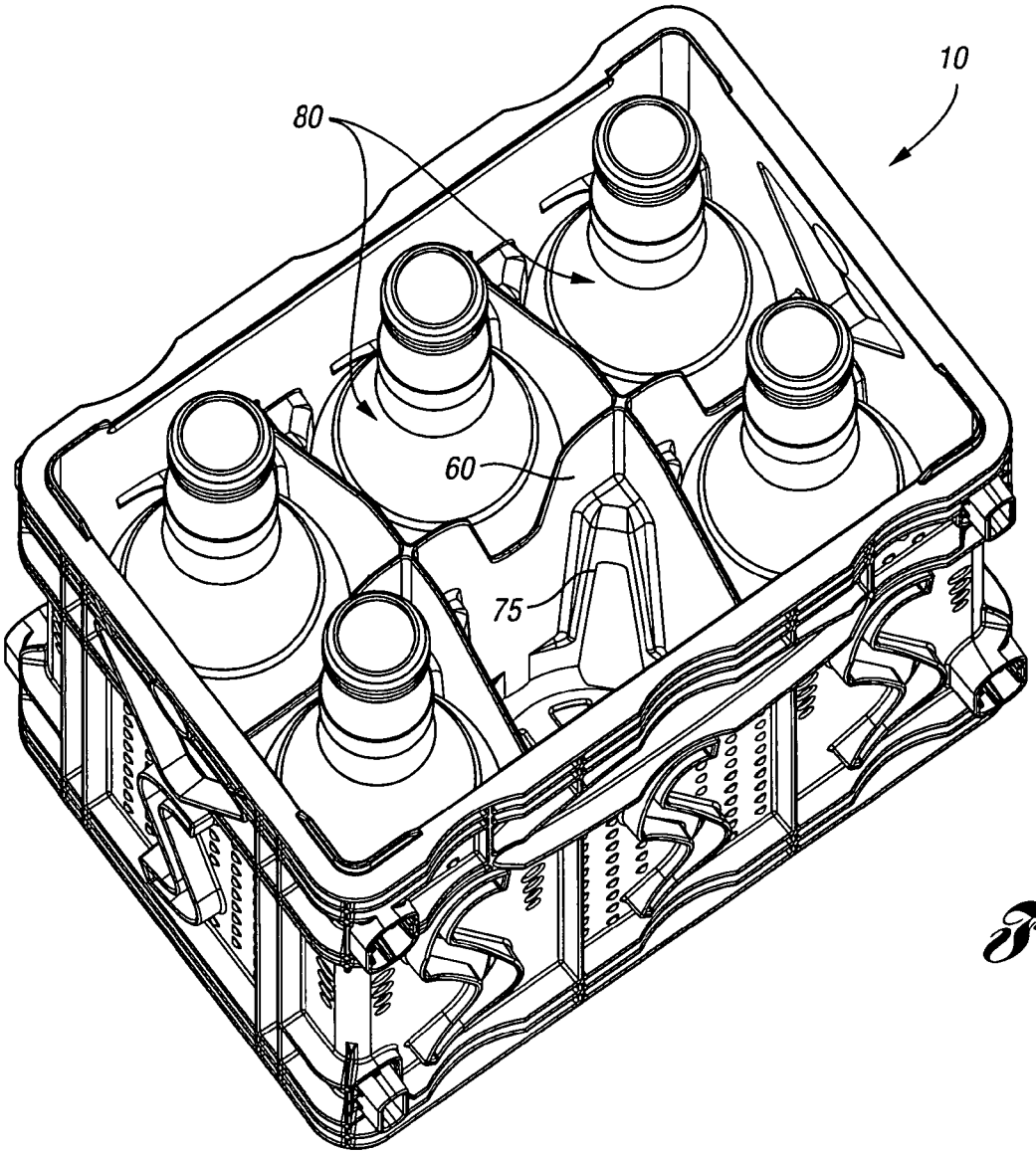
FIG. 6 is a view similar to FIG. 5, with one of the bottles removed.

FIG. 5 is perspective view of a carrier 10 in which a plurality of bottles 80 have been inserted between the dividers 60. Although other bottles or containers could be used, wine bottles 80, each having a neck portion 82, a transition portion 84 and a body portion 86, are shown for purposes of illustration. FIG. 6 is another perspective view of the carrier 10 holding a plurality of bottles 80 with one of the bottles 80 removed to show the column 75.

Figure 7:
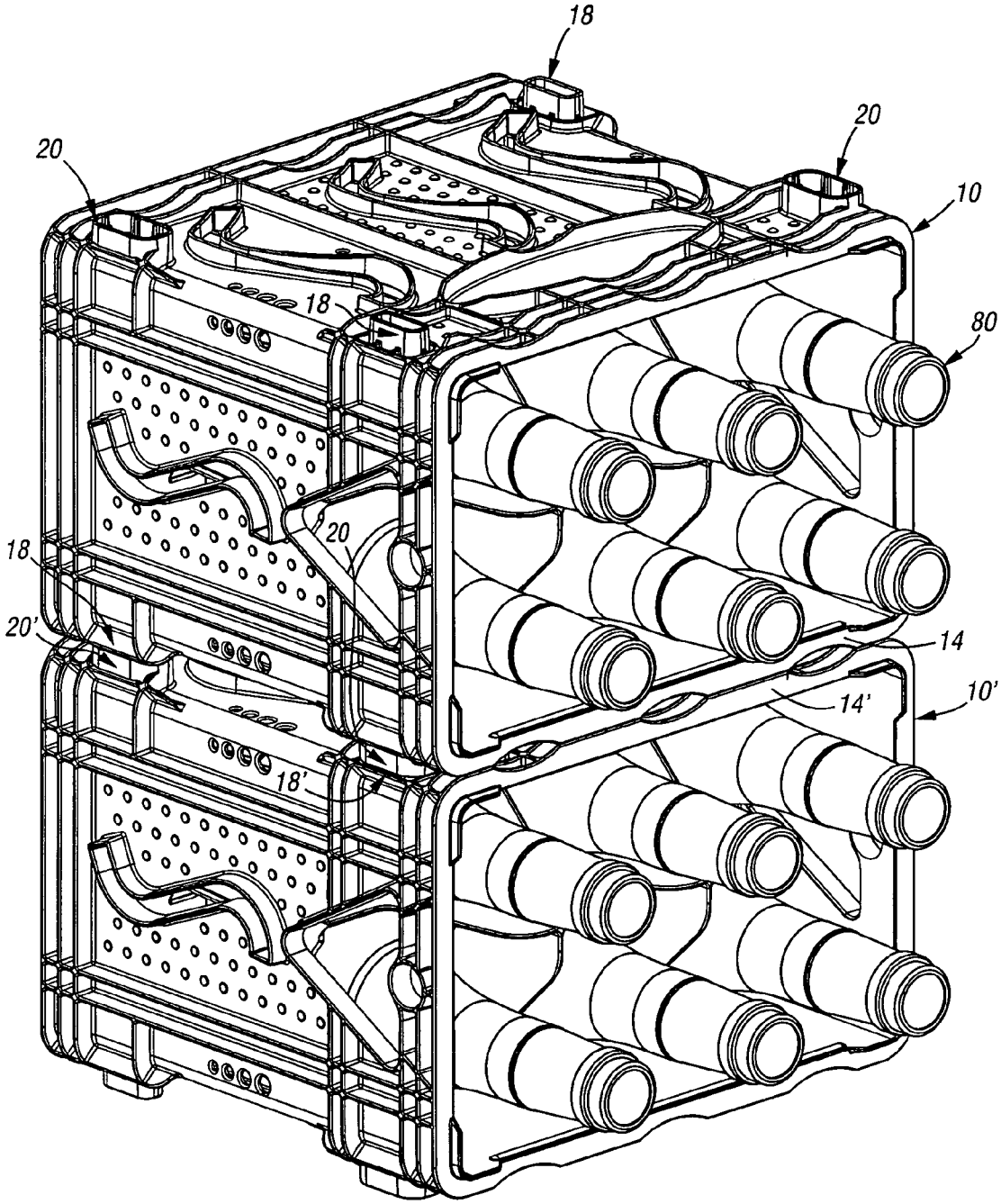
FIG. 7 is a perspective view of two carriers stacked together.
Figure 8:
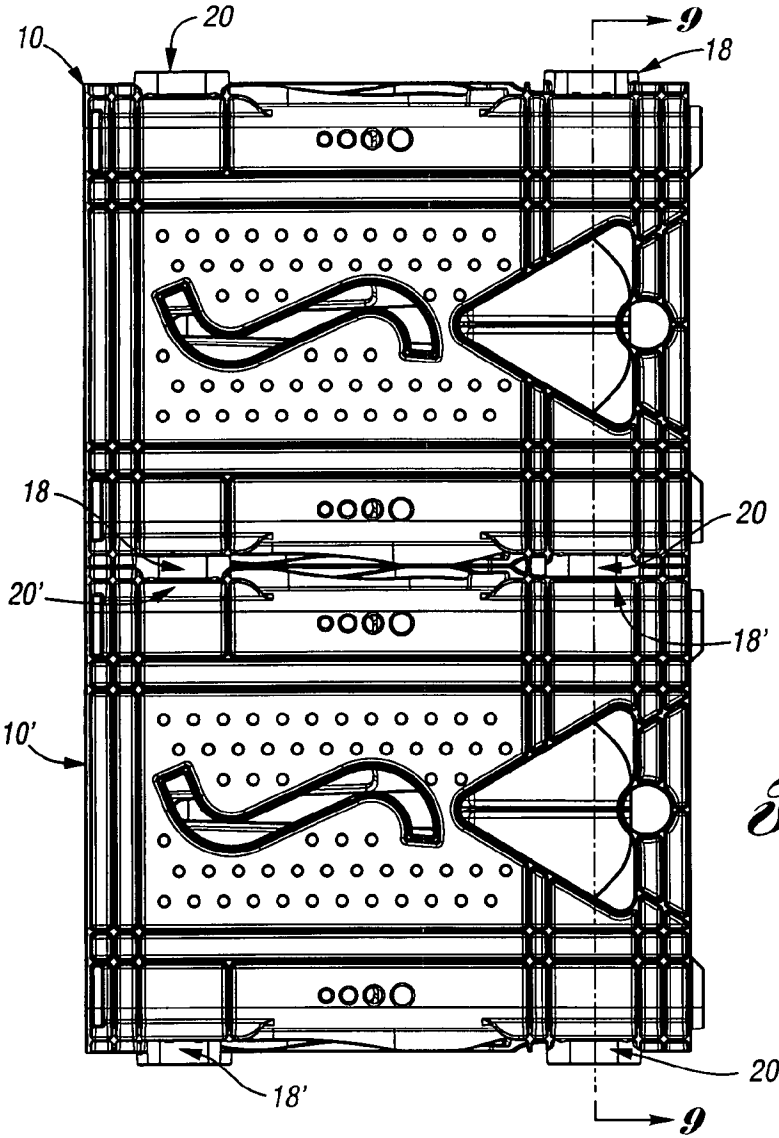
FIG. 8 is a side view of the carriers of FIG. 7.

Referring to FIGS. 7 and 8, in order to create a wine display or storage rack, one carrier 10 can be stacked upon another similar or identical wine carrier 10', with one side wall 14 resting upon the other side wall 14'. The second feet 20 of the upper carrier 10 are interlocked with the first feet 18' of the carrier 10', and vice versa.

Figure 9:
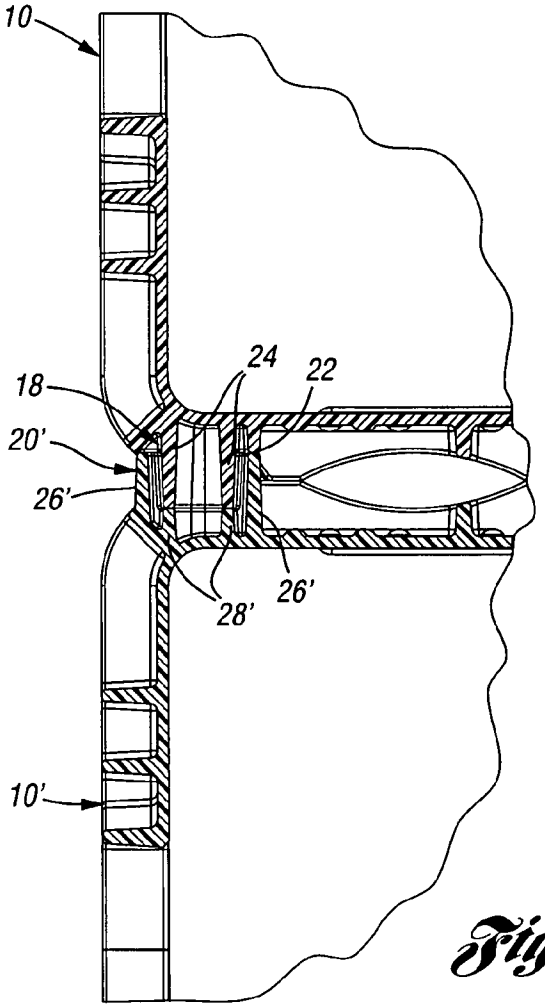
FIG. 9 is an enlarged view of a portion of a section through line 9-9 of FIG. 8.

FIG. 9 is an enlarged area of a section through line 9-9 of FIG. 8. As can be seen in FIG. 9, the first foot 18 of the upper carrier 10 is stacked on and interlocked with a second foot 20' of the lower carrier 10'. Interlocking is provided by the different, complementary heights of the ribs and walls 22, 24, 26', 28'. The outer wall 26' abuts the outer rib 22, while the outermost edges of inner walls 24, 28' abut one another.

Figure 10:
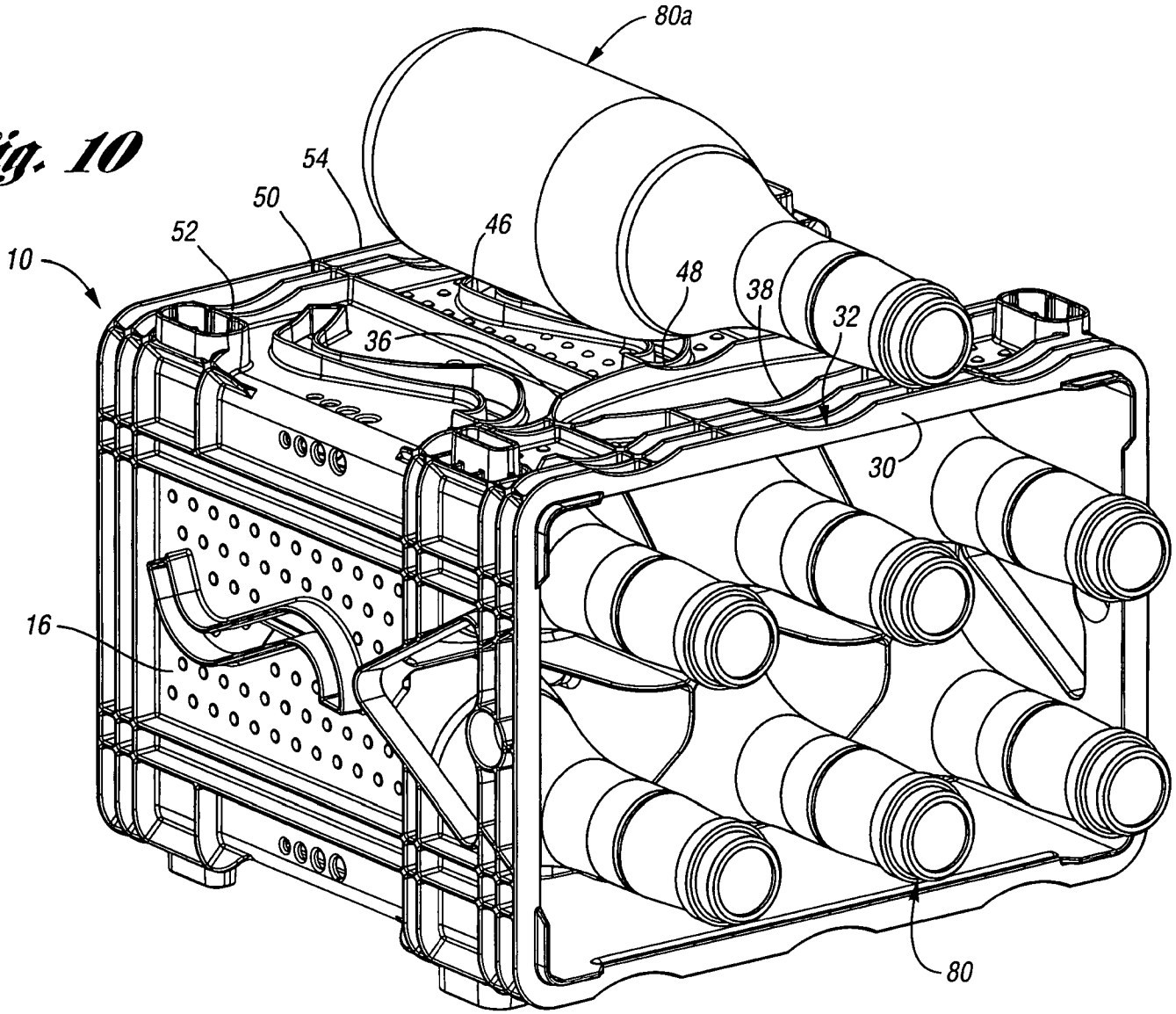
FIG. 10 is a front perspective view of the carrier in a horizontal position loaded with a plurality of bottles and supporting a bottle thereon.

Referring to FIG. 10, the aligned bottle-receiving concave portions 38, 48, 52 of the ribs 36, 46, 50 on side wall 14 can retain a bottle 80*a* horizontally on the exterior of the carrier 10. The bottom rib 54 prevents the bottle 80*a* from sliding past the rear of the carrier 10. The concave portion 32 of the upper ribs 30 facilitates sliding the bottle 80*a* off the front of the carrier 10, if the carrier 10 is high enough. The carrier 10 can also be stored on its end walls 16.

Figure 11:
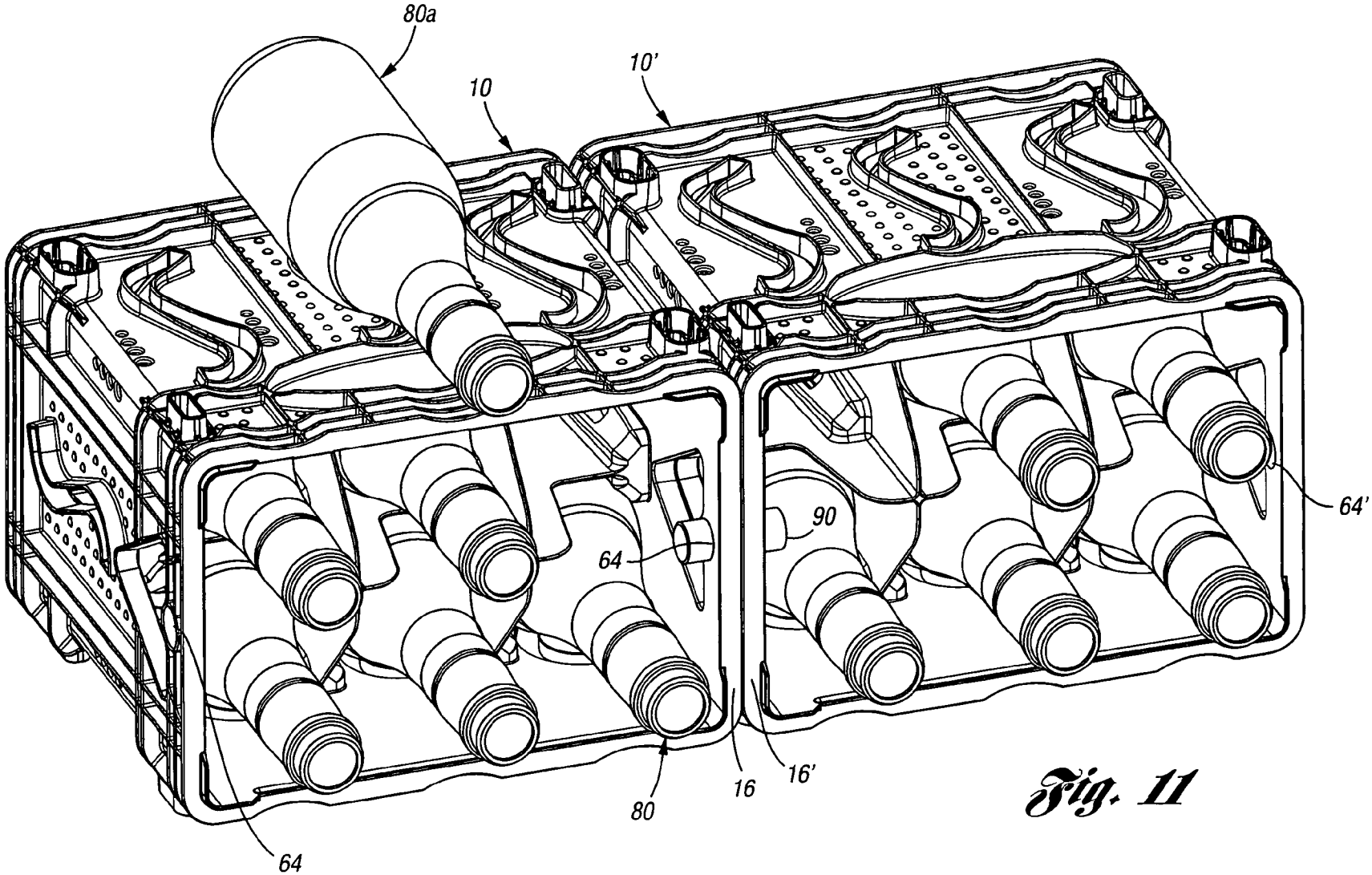
FIG. 11 is a front perspective view of the carrier and bottles of FIG. 10 connected to another loaded carrier.

Referring to FIG. 11, the connection aperture 64 in each end wall 16 can be used for connecting adjacent carriers 10, 10'. A cork 90, such as from the wine bottle 80, or other cylindrical connector 90 is inserted into the connection apertures 64, 64' in the adjacent end walls 16, 16' of the carriers 10, 10'. The apertures 64, 64' are sized and/or shaped so that the cork or other connector 90 will be wedged tightly into the apertures 64, 64'. Additional carriers could be connected to the carrier 10' in a similar manner.

Figure 12:
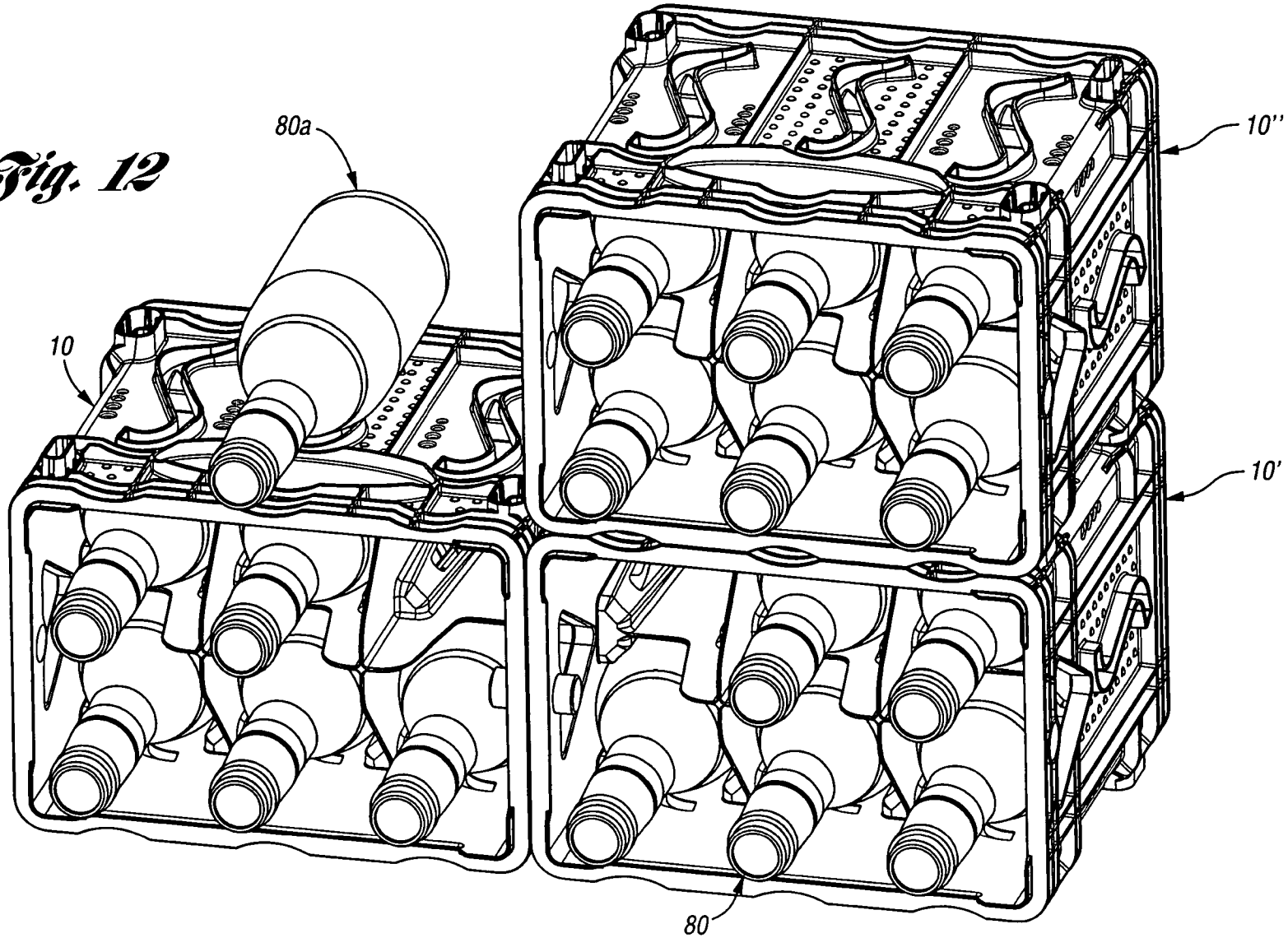
FIG. 12 is a front perspective view of several of the example carriers stacked together to form a larger display rack.

By combining the stacking and horizontal connection features of FIGS. 7 and 11, one can begin to build a display or storage rack as shown in FIG. 12, where carriers 10, 10' are connected horizontally and carriers 10, 10" are stacked.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A rack for beverage bottles comprising:

a first carrier and a second carrier each having at least one base wall, opposing side walls extending upwardly from the at least one base wall and an end wall extending upwardly from the at least one base wall and connecting the side walls, each end wall including a connection aperture therethrough, a wine bottle cork extending through the connection apertures in the first carrier and the second carrier to connect the first carrier to the second carrier.

2. The rack of claim 1 wherein the opposing side walls of the first carrier and the second carrier each include a pair of diagonally-spaced first feet and a pair of diagonally-spaced second feet extending therefrom, the first feet and second feet interlockable with the second feet and first feet, respectively, of a similar third carrier.

3. The rack of claim 2 wherein the first feet can be received within the second feet of the similar third carrier.

4. A bottle carrier for beverage bottles comprising:

at least one base wall;

a plurality of generally parallel walls extending up from the at least one base wall including a side wall connected to the at least one base wall, the side wall including a recess on an exterior surface for retaining a bottle thereon; and a plurality of ribs protruding transversely from the side wall, wherein each rib has a concave portion formed at a free outer end thereof, the concave portions of the plurality of ribs align to form the recess.

5. The bottle carrier of claim 4 wherein the recess is a first recess and each concave portion is a first concave portion, the side wall further including a plurality of recesses for retaining bottles therein including the first recess, the plurality of recesses formed by a plurality of concave portions including the first concave portions in the plurality of ribs.

6. The bottle carrier of claim 4 wherein one of the plurality of ribs is an end rib and the end rib has a bottle containing portion aligned with the recesses of the remaining plurality of ribs.

7. The bottle carrier of claim 4 wherein one of the plurality of ribs comprises a logo rib.

8. The bottle carrier of claim 7 wherein the logo rib at least substantially circumscribes an opening through the side wall.

9. The bottle carrier of claim 8 wherein the opening is generally "S" shaped.

10. The bottle carrier of claim 4 wherein the side wall includes a first foot formed adjacent an end wall and a second foot formed adjacent an opposing end wall, wherein the first foot is formed to interlock with a complementary second foot on a similar bottle carrier.

11. The bottle carrier of claim 4 further including an end wall connected to the base wall, the end wall including an opening extending through the end wall to form a connection aperture.

12. The bottle carrier of claim 11 wherein the connection aperture corresponds to a second connection aperture on a second similar carrier, and a cylindrical connector is insertable through both connection apertures to retain the first and second carrier to one another.

13. The bottle carrier of claim 4 further including a plurality of dividers generally transverse to the at least one base wall and defining bottle-receiving pockets between the plurality of walls.

14. The bottle carrier of claim 13 wherein the at least one base wall includes a plurality of base walls, the bottle carrier further including a plurality of columns extending upward from the plurality of base walls to define one of the bottle-receiving pockets on each of the plurality of base walls.

15. The bottle carrier of claim 14 wherein the bottle carrier is integrally molded as a single plastic piece.

16. The bottle carrier of claim 4 wherein plurality of ribs extend outwardly from the side wall.

17. A bottle carrier for beverage bottles comprising:

at least one base wall;

a first side wall and a second side wall connected to the at least one base wall, the first side wall and the second side wall each including a pair of diagonally-spaced first feet and a pair of diagonally-spaced second feet extending therefrom, the first feet of the first side wall interlockable with the second feet of the second side wall of a similar second carrier; and a plurality of dividers generally transverse to the at least one base wall and extending from the first side wall to the second side wall to define bottle-receiving pockets.

18. The bottle carrier of claim 17 further including an end wall connected to the at least one base wall and to the first side wall and the second side wall, the end wall including an opening extending through the end wall to form a connection aperture.

19. The bottle carrier of claim 18 in combination with a similar third carrier, further including a cylindrical connector inserted though the connection apertures of the bottle carriers to retain the bottle carriers to one another.

20. The bottle carrier of claim 19 wherein the connector is a cork for a wine bottle.

21. The bottle carrier of claim 19 wherein the similar second carrier is stacked on the bottle carrier and the similar third carrier is horizontally adjacent the bottle carrier.

22. The bottle carrier of claim 17 wherein at least one of the first side wall and the second side wall includes a recess on an exterior surface for retaining a bottle horizontally thereon.

23. The bottle carrier of claim 22 wherein the at least one of the first side wall and the second side wall includes a plurality of ribs projecting transversely therefrom, wherein each rib has a concave portion, the concave portions of the plurality of ribs aligned with one another to form the recess.

24. The bottle carrier of claim 23 wherein one of the plurality of ribs is an end rib and the end rib has a bottle containing portion aligned with the recesses of the remaining plurality of ribs.

25. The bottle carrier of claim 23, wherein at least one of the plurality of ribs is a logo rib, the logo rib forming indicia on the bottle carrier, the logo rib including a plurality of aligned concave portions.

26. The bottle carrier of claim 25 wherein the logo rib substantially circumscribes an opening through the at least one of the first side wall and the second side wall.

27. The bottle carrier of claim 17 wherein the at least one base wall includes a plurality of base walls, the bottle carrier further including a plurality of columns extending upwardly from the plurality of base walls to define a bottle-receiving pocket on each of the plurality of base walls, the plurality of base walls connected to one another and to the first side wall and the second side wall by the plurality of columns.

28. The bottle carrier of claim 17 wherein the bottle carrier is a first carrier, the first carrier in combination with the similar second carrier stacked thereon with the feet of the first side wall of the first carrier interlocked with the second side wall of the second carrier.

29. The bottle carrier of claim 28 further including an end wall connected to the at least one base wall, the first side wall and the second side wall, the end wall including an opening extending through the end wall to form a connection aperture.

30. The bottle carrier of claim 29 being in combination with a similar third carrier and further including a cylindrical connector inserted through the connection apertures of the first carrier and the third carrier to retain the first and third carriers to one another.

31. The combination of claim 29 further including a plurality of bottles in the first carrier and in the second carrier.

32. The combination of claim 31 wherein the first carrier and the second carrier each include a recess on an exterior surface of the second side wall, a bottle disposed in the recess on the second side wall of the second carrier.

33. A bottle carrier for beverage bottles comprising:

a plurality of base walls;

a first side wall and a second side wall each connected to at least one base wall of the plurality of base walls, the first side wall including a plurality of feet extending therefrom, the feet interlockable with the second side wall of a similar second carrier; and a plurality of columns extending upward from the plurality of base walls to define a bottle-receiving pocket on each of the plurality of base walls, the plurality of base walls connected to one another and to the first side wall and the second side wall by the plurality of columns, wherein the plurality of base walls, the first side wall, the second side wall and the plurality of columns are all integrally molded as a single plastic piece, wherein the columns open downwardly between the plurality of base walls, such that the columns are open to an underside of the carrier between the plurality of base walls.

34. The bottle carrier of claim 33 wherein the plurality of feet include first feet and second feet, the first feet having an inner wall that is receivable into second feet of a second carrier.

* * * * *